US007876279B2

(12) United States Patent
Ma

(10) Patent No.: US 7,876,279 B2
(45) Date of Patent: Jan. 25, 2011

(54) ANTENNA

(75) Inventor: Guozhong Ma, Farnborough (GB)

(73) Assignee: Nokia Corporation, Espoo (FI)

( * ) Notice: Subject to any disclaimer, the term of this patent is extended or adjusted under 35 U.S.C. 154(b) by 851 days.

(21) Appl. No.: 11/628,914

(22) PCT Filed: Jun. 27, 2005

(86) PCT No.: PCT/IB2005/001961

§ 371 (c)(1),
(2), (4) Date: Jul. 23, 2007

(87) PCT Pub. No.: WO2006/006061

PCT Pub. Date: Jan. 19, 2006

(65) Prior Publication Data

US 2008/0042916 A1 Feb. 21, 2008

(30) Foreign Application Priority Data

Jun. 30, 2004 (GB) ..... 0414575.1

(51) Int. Cl.
*H01Q 13/10* (2006.01)

(52) U.S. Cl. ..... 343/767

(58) Field of Classification Search ..... 343/767, 343/700 MS, 702

See application file for complete search history.

(56) References Cited

U.S. PATENT DOCUMENTS

| | | | | |
|---|---|---|---|---|
| 5,557,293 | A | 9/1996 | McCoy et al. | 343/867 |
| 6,133,879 | A | 10/2000 | Grangeat et al. | 343/700 MS |
| 6,727,854 | B2 * | 4/2004 | Fang et al. | 343/700 MS |
| 6,734,826 | B1 | 5/2004 | Dai et al. | 343/700 MS |
| 6,989,785 | B2 * | 1/2006 | Sievenpiper et al. | 342/175 |
| 7,071,877 | B2 * | 7/2006 | Okado | 343/700 MS |
| 7,102,572 | B2 * | 9/2006 | Okado | 343/700 MS |
| 7,605,769 | B2 * | 10/2009 | Lee et al. | 343/770 |
| 7,679,565 | B2 * | 3/2010 | Sorvala | 343/700 MS |
| 2003/0103015 | A1 | 6/2003 | Oh et al. | 343/867 |
| 2004/0090372 | A1 | 5/2004 | Nallo et al. | 343/700 MS |
| 2004/0100410 | A1 | 5/2004 | Tsai et al. | 343/702 |
| 2004/0246179 | A1 | 12/2004 | Chen et al. | 343/700 MS |
| 2007/0040745 | A1 * | 2/2007 | Chen et al. | 343/700 MS |
| 2009/0135007 | A1 * | 5/2009 | Donovan et al. | 340/540 |
| 2009/0256763 | A1 * | 10/2009 | Chi et al. | 343/741 |

FOREIGN PATENT DOCUMENTS

JP 2003101326 A 9/2001

* cited by examiner

*Primary Examiner*—Huedung Mancuso
(74) *Attorney, Agent, or Firm*—Harrington & Smith

(57) ABSTRACT

An antenna having a plurality of resonant frequencies and including a feed point; a ground point; and an antenna track extending between the feed point and the ground point and including, in series, a first small loop, a large loop and a second small loop. In one embodiment, the extension of the antenna track through the first U-shaped small loop displaces the antenna track in a first direction, then the extension of the antenna track through the large U-shaped loop displaces the antenna track in a second direction opposite to the first direction and the extension of the antenna track through the second U-shaped small loop displaces the antenna track in the first direction. A bridge element may be used.

23 Claims, 3 Drawing Sheets

ANTENNA

FIELD OF THE INVENTION

Embodiments of the invention relate to radio frequency antenna, and in particular antennas that are suitable for use in multi-band hand-portable cellular radio terminals, such as mobile cellular telephones.

BACKGROUND TO THE INVENTION

Planar inverted F antennas (PIFA) are widely used as internal antenna for hand-portable radio communication terminals, such as mobile cellular telephones. However, a PIFA requires the antenna element to be mounted over 6 mm from the ground plane, as the PIFA bandwidth is proportional to this separation distance.

If the height of the antenna element above the ground plane is decreased, the bandwidth decreases and the antenna is unable to adequately cover EGSM (or UGSM) band. Typically a PIFA needs over 6 mm height to have enough bandwidth and efficiency for EGSM. If the height is decreased below 6 mm the PIFA cannot cover the EGSM band adequately.

If the PIFA height is increased, the bandwidth increases and the antenna is able to adequately cover both USGSM and EGSM bands, but the volume occupied by the antenna increases.

This is undesirable in hand-portable cellular radio terminals, such as mobile cellular telephones.

It would therefore be desirable to provide a low profile, multiband antenna.

BRIEF DESCRIPTION OF THE INVENTION

According to one embodiment of the invention there is provided an antenna having a plurality of resonant frequencies and comprising: a ground plane; a feed point; a ground point; and an antenna track extending, parallel to the ground plane, between the feed point and the ground point and comprising, in series, a first small loop, a large loop and a second small loop.

Such an antenna may have a reduced separation distance between the plane of the antenna track and the ground plane (3-4 mm) when compared to a PIFA, and produces enough bandwidth and efficiency at the EGSM band.

According to another embodiment of the invention there is provided an antenna having a plurality of resonant frequencies and comprising: a feed point; a ground point; and an antenna element extending between the feed point and the ground point and forming a first loop and a second larger loop wherein a first portion of the first loop and a first portion of the second loop are comprised of physically separate antenna tracks that are electrically parallel and wherein a second portion of the first loop and a second portion of the second loop are comprised of a first shared antenna track, and wherein the first loop has a first resonant frequency and the second loop has a second resonant frequency wherein the second resonant frequency is greater than the first resonant frequency.

Such an antenna may have a reduced separation distance between the plane of the antenna track and the ground plane.

BRIEF DESCRIPTION OF THE DRAWINGS

According to a further embodiment of the invention there is provided an antenna having at least a first and second resonant frequency and comprising: a feed point; a ground point; and an element extending between the feed point and the ground point and forming a first loop having a first resonant frequency, a bridging element between a first and second position of the first loop to form a second smaller loop having a second resonant frequency, wherein the first resonant frequency is greater than the second resonant frequency.

For a better understanding of the invention and to understand how it may be brought into effect reference is made by way of example only, to the accompanying drawings in which.

DETAILED DESCRIPTION OF EMBODIMENT(S) OF THE INVENTION

Figure 1:
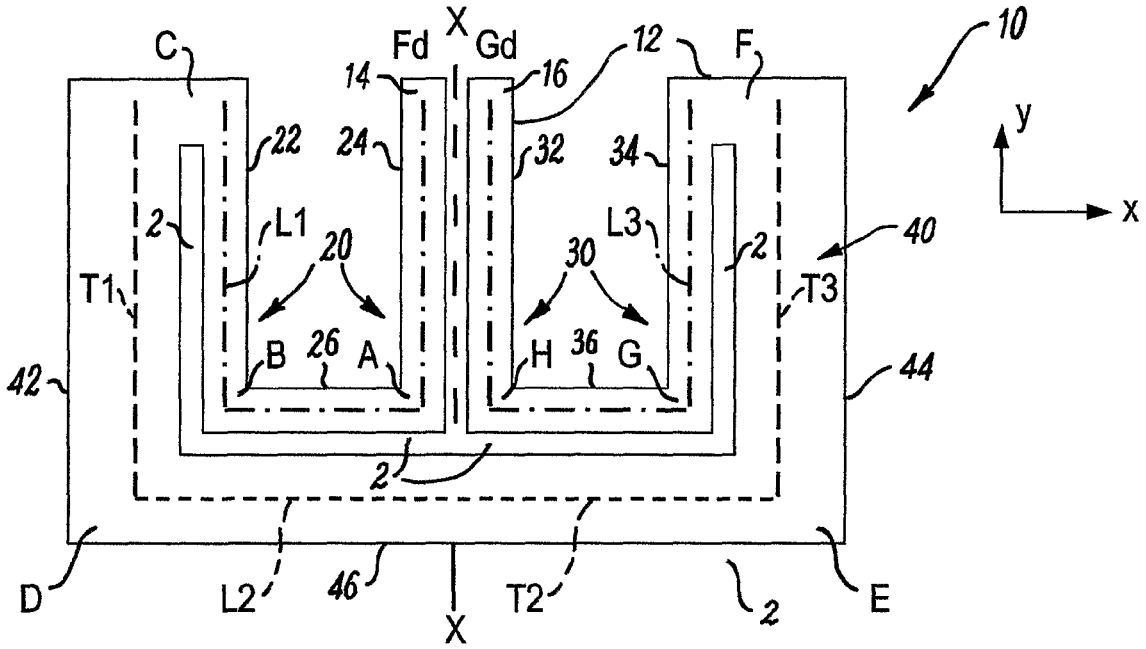
FIG. 1 illustrates a multiband radio antenna.

The Figures illustrate an antenna 10 having a plurality of resonant frequencies and comprising: a feed point 14; a ground point 16 adjacent the ground point; and an antenna track 12 extending, parallel to a ground plane 2, between the feed point 14 and the ground point 16 and comprising, in ordered series, a first small loop 20, a large loop 40 and a second small loop 30. The extension of the antenna track 12 through the first U-shaped small loop 20 displaces the antenna track in a first direction, then the extension of the antenna track 12 through the large U-shaped loop 40 displaces the antenna track 12 in a second direction opposite to the first direction and the extension of the antenna track 12 through the second U-shaped small loop 30 displaces the antenna track in the first direction.

Figure 4A:
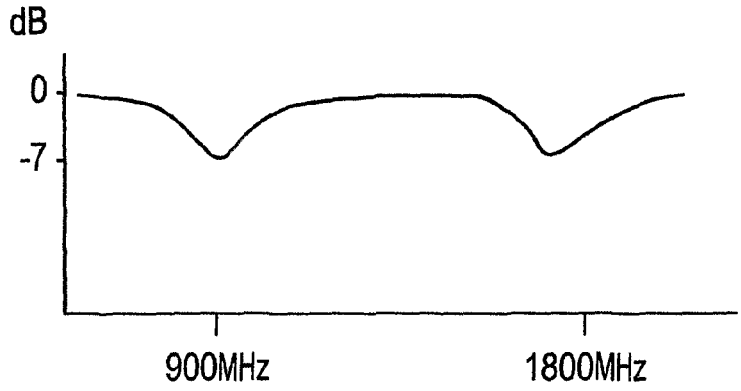
FIGS. 4A and 4B illustrate the insertion loss for the antennas illustrated in FIG. 1 and FIG. 3 respectively.

FIG. 1 illustrates a multiband radio antenna 10 that has two resonant frequencies as illustrated in FIG. 4A. The first, lower resonant frequency has a bandwidth that covers the USGSM and EGSM bands (824-960 MHz with VSWR of 2 at band edges) and the second, higher resonant frequency has a bandwidth that covers the DCS and PCS bands (1710-1990 MHz with VSWR of 2 at band edges). The antenna comprises a single antenna track 12 that lies within a single plane that is separated from a ground plane 1 by a height h of 3-4 mm. An x-y co-ordinate system is included in the figure and is used, below, to describe the antenna shape with reference to vectors (x, y). Normally a layer of substrate lies between the antenna track and ground plane 1, which is used as an antenna frame.

The antenna track 12 comprises in series, between a feed point 14 and a ground point 16, a first small U-shaped loop 20, a large U-shaped loop 40 and a second small U-shaped loop 30. The large U-shaped loop 40 doubles back between the first small U-shaped loop 20 and the second small U-shaped loop 30, thereby straddling and containing them. The track 12 has a terminus at the feed point 14 and a terminus at the ground point 16.

The track 14 extends from a feed point 14 in the direction (0, −1), it takes a right-angled right turn at point A and extends in the direction (−1,0) to point B, where it takes another right-angled right turn and then extends in direction (0,1) to point C. This portion of the track forms the first small loop 20 that has a square-bottomed U-shape. The first small loop 20 has two parallel side portions (a left side portion 22 and a right side portion 24) and a bottom portion 26. The total combined length of these portions i.e. the distance between the feed point 14 and point C along the track 12, is L1.

At point C, the track 14 makes an about turn and extends from point C in the direction (0,−1) to point D, where it takes a right-angled left turn and then extends in direction (1,0) to point E, where it takes another right-angled left turn and extends in the direction (0,1) to point F. This portion of the track 12 forms the large loop 40, which has a square bottomed U-shape. The large loop 40 has two parallel side portions (a left side portion 42 and a right side portion 44) and a bottom portion 46. The total combined length of these portions i.e. the distance between the point C and point F along the track 14 is L2.

The left side portion 42, has a length T1 and runs parallel to the left side portion 22 of the first small loop 20 with a small constant gap 2 between them. The bottom portion 46 has a length T2 and runs parallel to the bottom portion 26 of the first small loop 20 with the same constant gap 2 between them. The right side portion 44 has a length T3, which is equal to T1.

At point F, the track 14 makes an about turn and extends in direction (0, −1), takes a right-angled right turn at point G and extends in the direction (−1,0) to point H, where it takes another right-angled right turn and then extends in direction (0,1) to a ground point 16, adjacent the feed point 14. This portion of the track 12 forms the second small loop 30, which has a square bottomed U-shape. The second small loop 30 has two parallel side portions (a left side portion 32 and a right side portion 34) and a bottom portion 36. The total combined length of these portions i.e. the distance between the point F and the ground point 16 along the track 14 is L3.

The bottom portion 36 runs parallel to the bottom portion 46 of the large loop 40 with the constant gap 2 between them. The right side portion 34 runs parallel to the right side portion 44 of the large loop 40 with the constant gap 2 between them. The left side portion 32 runs parallel to the right side portion 24 of the first small loop 20 with a small constant separation 1-3 mm between them.

The gap 2 has a constant width of the order of 1-2 mm. The track width W1 of the first small loop 20 is constant along the length L1 of the loop 20. The track width W3 of the second small loop 30 is constant along the length L3 of the loop 30 and is the same as W1. The width W2 of the track 12 for the large loop 40 is greater than W1 and constant along its length L2.

In the example shown, the dimensions of the radio antenna 10 are 45 mm (C to F (D to E) and 18 mm C to D (F to E). The width W1 is approximately 1.5 mm-2.5 mm and the width W2 is approximately 5 mm-7 mm.

In this example, the first small loop 20, the second small loop 30 and the large loop 40 are all oriented in the same direction, with the bottom portions 26, 36 of the small loops being parallel to consecutive parts of the bottom portion 46 of the large loop 40 and separated there from by the small gap 2.

The antenna 10 is substantially symmetric. It has substantial reflection symmetry in the line X-X. Also the length T1 equals T2 and L1 equals L3. The first small loop 20 lies to one side of the line X-X and the second small loop 30 lies on the other side. The large loop 40 straddles and is bisected by the lines X-X.

In this particular example, the length of the large loop 40, L2, is approximately equal to the sum of the lengths of the first small loop 20 and the second small loop 30 (L1+L3) i.e. L2=L1+L3. The length (T2) of the base portion 46 of the large loop is approximately twice the length (T1) of the left-side portion 42 i.e. T2=T1+T3.

At lower frequencies (e.g. of the order of 900 MHz) the antenna 10 operates as a loop antenna. The antenna has a resonant frequency such that its corresponding wavelength $\lambda_{lowf}$ is equal to twice the total length of the track 12.

$$L1+L2+L3=\lambda_{lowf}/2$$

At higher frequencies (e.g. of the order of 1800 MHz), the antenna 10 operates as a patch antenna. The antenna has a resonant frequency such that its corresponding wavelength $\lambda_{highf}$ is equal to twice the length of the large loop 40.

$$L2=T1+T2+T3=\lambda_{highf}/2$$

When operating at high frequencies, small loops 20 and 30 act as matching networks or circuits. In the particular example illustrated in FIG. 1, $\lambda_{lowf}$ is approximately twice $\lambda_{highf}$. For example $\lambda_{highf}$ may correspond to a frequency of 1800 MHz and $\lambda_{lowf}$ may correspond to a frequency of 900 Mhz. In this case, L1+L3=L2.

Figure 5:
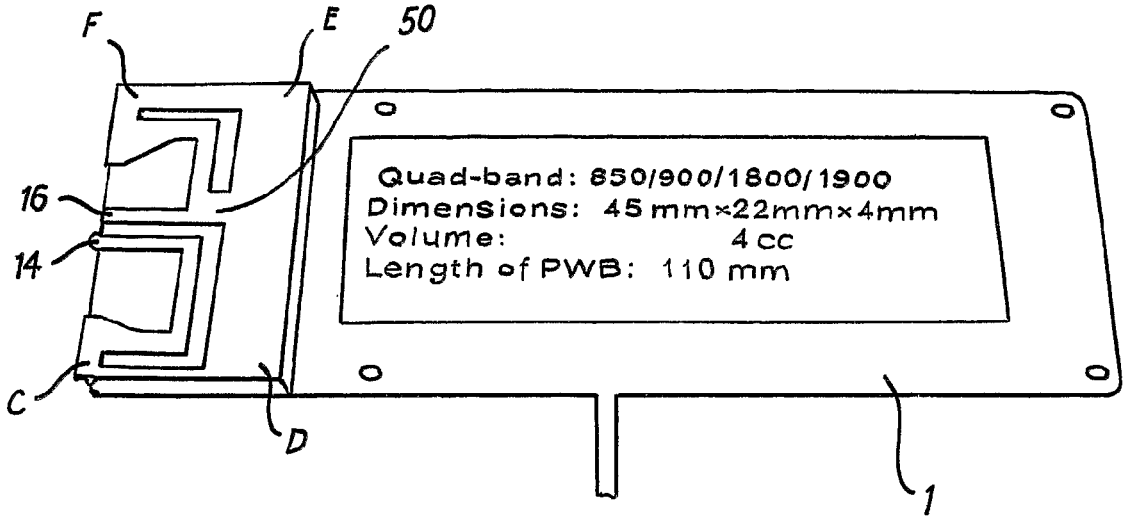
FIG. 5 illustrates a variation to the multiband antenna illustrated in FIG. 3.

Although the antenna 10 has been illustrated as having sharp angular curves and constant track width, it may be desirable to add capacitive loading to the track 12 as illustrated in FIG. 5. This may involve, for example, adding track to the exterior of sharp bends, particularly to the left portion 22 of the first small loop 20 at point C and to the right portion 34 of the second small loop 30 at point F. This may result in the first small loop 20 and the second small loop 30 not being identical or symmetrical.

Although the antenna illustrated in FIG. 1 is such that L1 substantially equals L2, this is not a requirement for the correct operation of the antenna.

Although the turns in the antenna track illustrated in FIG. 1 are right-angled, this is not necessary for the proper operation of the antenna. The loops 20, 30, 40 need not be U shaped and need not be U shaped with square bottoms.

Although the widths W1, W2, W3 of the antenna tracks illustrated in FIG. 1 are constant, this is not necessary for the proper operation of the antenna.

Although the gap 2 is described as a constant sized gap, this is not necessary for the proper functioning of the antenna. The size of the gap may vary although it is preferably no wider then the width of the track forming the small loops 20, 30.

Figure 2:
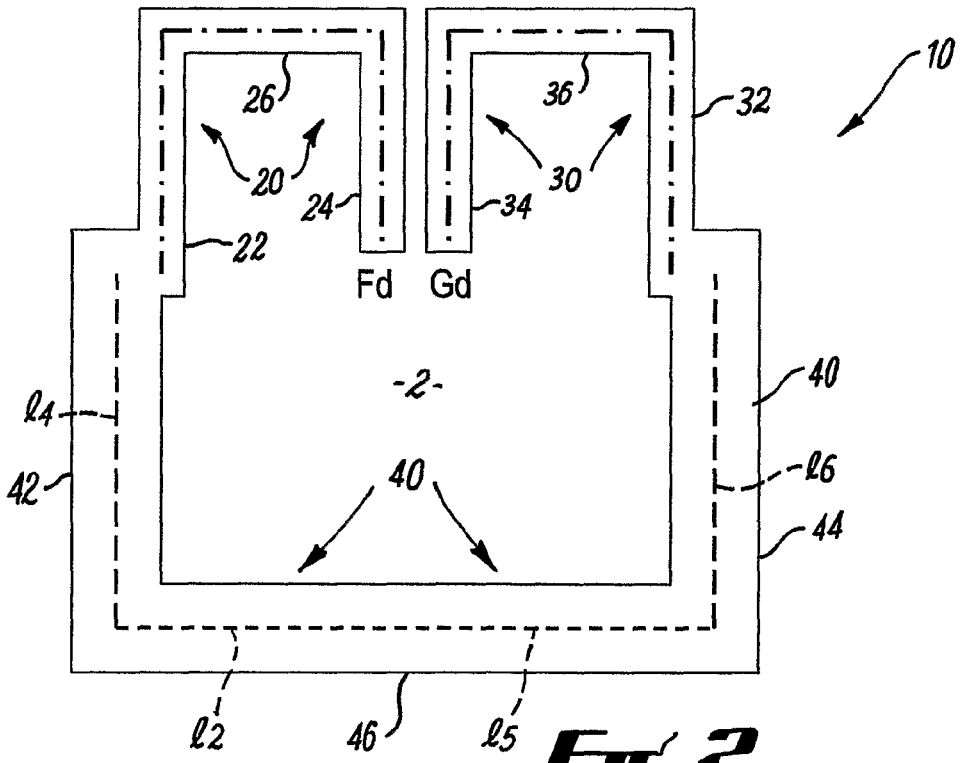
FIG. 2 illustrates an alternative multiband radio antenna.

An alternative configuration of the antenna 10 is illustrated in FIG. 2 and like reference numerals refer to like features. The antenna track 12 comprises in series, between a feed point 14 and a ground point 16, a first small U-shaped loop 20, a large U-shaped loop 40 and a second small U-shaped loop 30. The large U-shaped loop 40 doubles back between the first small U-shaped loop 20 and the second small U-shaped loop 30, thereby straddling them. The track 12 has a terminus at the feed point 14 and a terminus at the ground point 16. In this example, the first small U-shaped loop 20 and the second small U-shaped loop 30 have the same orientation which is opposite to that of the large U-shaped loop 40. The large loop 40 does not therefore contain the smaller loops as in FIG. 1. Thus the left side portion 22 and the bottom portion 26 of the first small loop 20 are no longer separated from the left side portion and bottom portion of the large loop 40 by a small gap 2. The right side portion 34 and the bottom portion 36 of the second small loop 30 are no longer separated from the right side portion 44 and bottom portion 46 of the large loop 40 by the small gap 2. The operation of the implementation illustrated in FIG. 2 is the same as described for FIG. 1. However, the implementation of FIG. 1 is preferred because it has a smaller area.

Figure 3:
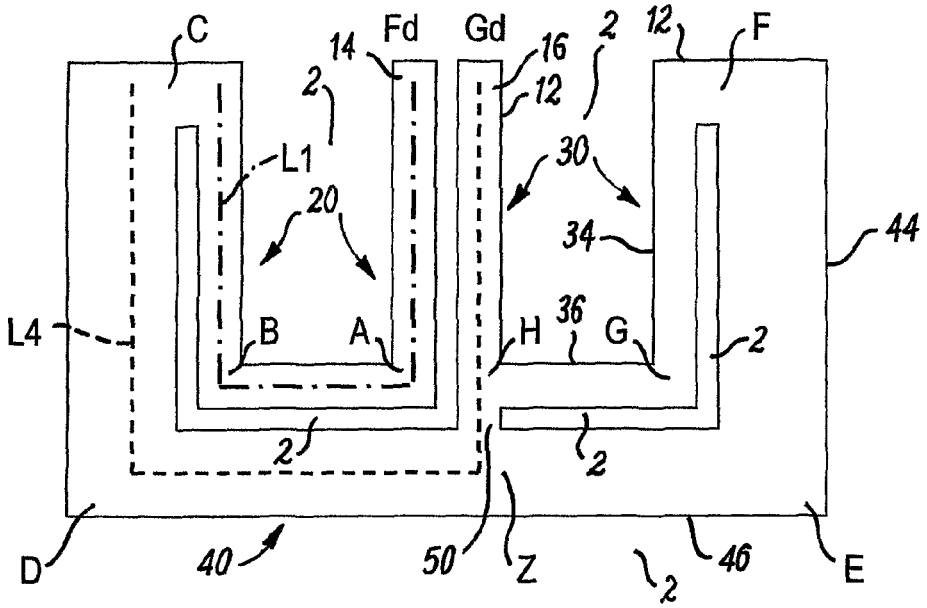
FIG. 3 illustrates an alternative multiband radio antenna.
Figure 4B:
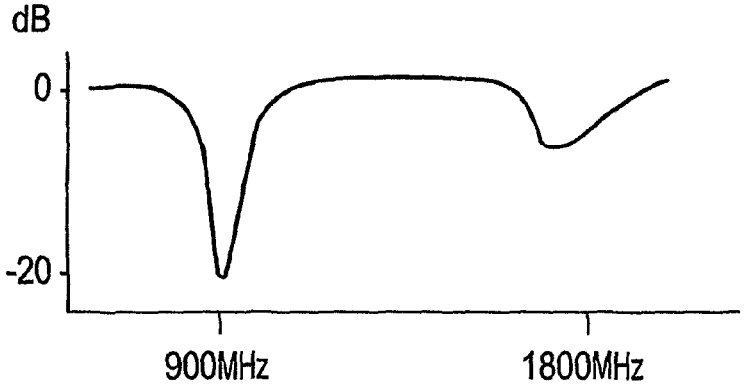

FIG. 3 illustrates a modification that may be made to the antenna as described in relation to FIG. 1. This multiband radio antenna has two resonant frequencies as illustrated in FIG. 4B.

A bridge element 50 is used to create a short-circuit connection between the large loop 40 and the second small loop 30. In this example, the bridge element 50 connects the bottom portion 46 of the large loop 40 to the bottom portion 36 of the second small loop 30, at point H. The bridge element bridges the small gap 2. Although shown in a particular position, the bridge element may bridge any part of the gap 2. In particular it may bridge any part of the gap 2 between the second small loop and the large loop 40. It may therefore extend between the bottom portions 36, 46 or the right side portions 34, 44.

The bridge element modifies the operation of the antenna 10 in the lower frequency range. It improves the antenna efficiency and bandwidth at low band (900 MHz). The short-circuit introduces a shorter loop antenna path between the feed point 14 and the ground point 16. Thus this loop antenna has a higher resonant frequency (at low band) than the antenna shown in FIG. 1, if the two antennas are of the same size. In the example of FIG. 3 the length of the loop for this second mode is L1+L4, where L4 is the distance between point C and the ground point 16 via the bridge element 50. The antenna has a resonant frequency such that its corresponding wavelength λlowf is such that:

$$L1+L4=\lambda_{lowf}/2$$

For this to correspond to the 900 MHz band it is necessary for the sizes of the small loops 20, 30 and the large loop 40 to be increased compared to the design illustrated in FIG. 1, but the antenna has increased efficiency and bandwidth at low band (900 MHz) as illustrated in FIG. 4B.

The antenna illustrated in FIG. 3 may alternatively be viewed as comprising two parallel loops. The first parallel loop track follows the path Fd-A-B-C-D-H-Gd and the second parallel loop track follows the path Fd-A-B-C-D-E-F-G-H-Gd. The two parallel loops share the same track Fd-A-B-C-D, there is then a bifurcation at point Z, where the bridge element 50 is located. The portion of track Z-H of the first parallel loop is electrically parallel to the portion of track Z-E-F-G-H of the second parallel loop. The two parallel loops then share the same track H-Gd.

Figure 6:
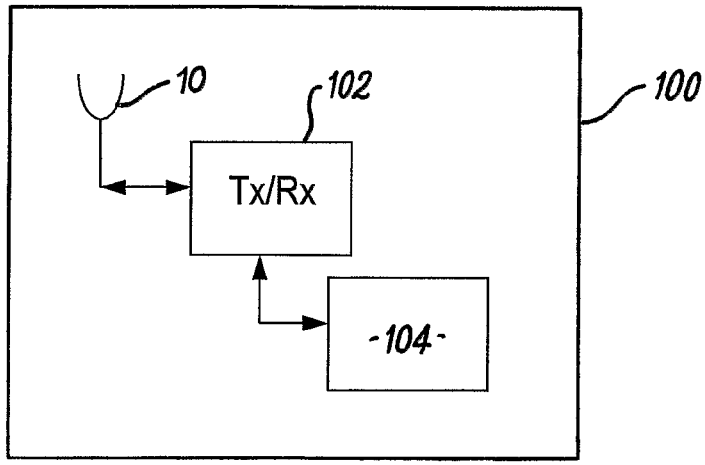
FIG. 6 illustrates a radio transceiver device comprising a multiband antenna.

FIG. 6 illustrates a radio transceiver device 100 such as a mobile cellular telephone, cellular base station, or other wireless communication device. The radio transceiver device 100 comprises a multiband antenna 10, as described above, radio transceiver circuitry 102 connected to the feed point of the antenna and functional circuitry 104 connected to the radio transceiver circuitry. In the example of a mobile cellular telephone, the functional circuitry 104 includes a processor, a memory and input/out put devices such as a microphone, a loudspeaker and a display. Typically the electronic components that provide the radio transceiver circuitry 102 and functional circuitry 104 are interconnected via a printed wiring board (PWB). The PWB may be used as the ground plane 1 of the antenna 10 as illustrated in FIG. 5.

Although embodiments of the present invention have been described in the preceding paragraphs with reference to various examples, it should be appreciated that modifications to the examples given can be made without departing from the scope of the invention as claimed.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An antenna comprising:

a ground plane;

a feed point;

a ground point; and an antenna track extending, parallel to the ground plane, between the feed point and the ground point and comprising, in series, a first small loop, a large loop and a second small loop wherein the antenna is configured to operate as a loop antenna at a first lower resonant frequency and as a patch antenna at a second higher resonant frequency.

2. An antenna as claimed in claim 1, wherein the extension of the antenna track through the first small loop displaces the antenna track along the first small loop in a first rotational direction, the extension of the antenna track through the second small loop displaces the antenna track along the second small loop in the first rotational direction, and the extension of the antenna track through the large loop displaces the antenna track along the large loop in a second rotational direction opposite to the first rotational direction.

3. An antenna as claimed in claim 1 , wherein the antenna is divided by an imaginary line and the first small loop is on one side of the imaginary line, the second small loop is on the other side of the imaginary line and the large loop is divided by the imaginary line.

4. An antenna as claimed in claim 3, wherein the antenna is substantially symmetric, and the imaginary line is a line of reflection symmetry.

5. An antenna as claimed in claim 1, wherein the first small loop, second small loop and large loop are substantially U-shaped.

6. An antenna as claimed in claim 1, wherein the first small loop and second small loop are of substantially equal length.

7. An antenna as claimed in claim 1, wherein the first small loop and second small loop have substantially the same width.

8. An antenna as claimed in claim 1, having a first resonant frequency and a second resonant frequency, wherein the first small loop has a length L1, the large loop has a length L2 and the second small loop has a length L3, where L1+L2+L3 substantially equals $\lambda_{lowf}/2$ and L2 substantially equals $\lambda_{highf}/2$, where $\lambda_{lowf}$ is a wavelength corresponding to the first resonant frequency and $\lambda_{highf}$ is a wavelength corresponding to the second resonant frequency.

9. An antenna as claimed in claim 1, wherein the large loop has a length substantially equal to the summation of the length of the first small loop and the length of the second small loop.

10. An antenna as claimed in claim 1, wherein a gap separates portions of the first small loop from corresponding portions of the large loop and separates portions of the second small loop from corresponding portions of the large loop.

11. An antenna as claimed in claim 10, wherein the gap is narrower than or equal to the width of the antenna track of the first small loop.

12. An antenna as claimed in claim 1, wherein the antenna has a wide bandwidth at a first resonant frequency that includes 900 MHz and a bandwidth at a second resonant frequency that includes 1800 MHz.

13. An antenna as claimed in claim 1, further comprising a bridge element connecting the large loop and the second small loop and bridging a gap between the large loop and second small loop.

14. An internal antenna arrangement for a mobile cellular telephone comprising an antenna as claimed in claim 1.

15. A radio transceiver device comprising an antenna as claimed in claim 1.

16. An antenna comprising:

a feed point;

a ground point; and an antenna element extending between the feed point and the ground point and forming a first loop and a second larger loop wherein a first portion of the first loop and a first portion of the second loop are comprised of physically separate antenna tracks that are electrically parallel and wherein a second portion of the first loop and a second portion of the second loop are comprised of a first shared antenna track, and wherein the first loop has a first resonant frequency and the second loop has a second resonant frequency wherein the second resonant frequency is greater than the first resonant frequency and wherein the antenna is configured to operate as a loop antenna at a first lower frequency and as a patch antenna at a second higher resonant frequency.

17. An antenna as claimed in claim 16, wherein the antenna element is formed from an antenna track that splits into two separate antenna tracks and then rejoins to form a single antenna track.

18. An antenna as claimed in claim 16, wherein the first shared antenna track extends from the feed point.

19. An antenna as claimed in claim 16, wherein a third portion of the first loop and a third portion of the second loop are comprised of a second shared antenna track.

20. An antenna as claimed in claim 19, wherein the second shared antenna track extends from the feed point.

21. An antenna comprising:

a feed point;

a ground point; and an element extending between the feed point and the ground point and forming a first loop having a first resonant frequency, a bridging element between a first and second position of the first loop to form a second smaller loop having a second resonant frequency, wherein the first resonant frequency is greater than the second resonant frequency and wherein the antenna is configured to operate as a loop antenna at the second resonant frequency and as a patch antenna at the first resonant frequency.

22. A method comprising:

providing an antenna by;

providing a ground plane;

providing a feed point;

providing a ground point; and providing an antenna track, extending, parallel to the ground plane, between the feed point and the ground point and comprising, in series, a first small loop and a second small loop, wherein the antenna is configured to operate as a loop antenna at a first lower resonant frequency and as a patch antenna at a second higher resonant frequency.

23. A method comprising:

providing an antenna by;

providing a feed point;

providing a ground point; and providing an antenna element extending between the feed point and the ground point and forming a first loop and a second larger loop wherein a first portion of the first loop and a first portion of the second loop are comprised of physically separate antenna tracks that are electrically parallel and wherein a second portion of the first loop and a second portion of the second loop are comprised of a first shared antenna track, and wherein the first loop has a first resonant frequency and the second loop has a second resonant frequency wherein the second resonant frequency is greater than the first resonant frequency and wherein the antenna is configured to operate as a loop antenna at a first lower resonant frequency and as a patch antenna at a second higher resonant frequency.

* * * * *